United States Patent [19]

Doi et al.

[11] Patent Number: 4,873,150

[45] Date of Patent: Oct. 10, 1989

[54] HIGH WATER-RESISTANT MEMBER, AND VALVE GEAR USING THE SAME FOR USE IN INTERNAL COMBUSTION ENGINE

[75] Inventors: Masayuki Doi, Katsuta; Naotatsu Asahi, Matsudo; Yoshitaka Kojima, Hitachi; Hisanobu Kanamaru, Katsuta; Susumu Aoyama, Kashiwa, all of Japan

[73] Assignee: Hitachi, Ltd., Tokyo, Japan

[21] Appl. No.: 112,493

[22] Filed: Oct. 26, 1987

[30] Foreign Application Priority Data

Oct. 27, 1986 [JP] Japan ..... 61-255261

[51] Int. Cl.[4] ..... F01L 1/00

[52] U.S. Cl. ..... 428/627; 428/660; 428/685; 123/90.39; 123/90.51

[58] Field of Search ..... 123/90.31, 90.51; 420/11, 12, 67, 68, 69, 428, 583; 428/627, 660, 685

[56] References Cited

U.S. PATENT DOCUMENTS 3,690,959 9/1972 Thompson ..... 123/90.51
4,583,502 4/1986 Takahashi et al. ..... 123/90.51

FOREIGN PATENT DOCUMENTS 521343 1/1956 Canada ..... 420/69
2075068 11/1981 United Kingdom ..... 428/660
8704760 12/1984 World Int. Prop. O. ..... 420/583

*Primary Examiner*—L. Dewayne Rutledge
*Assistant Examiner*—George Wyszomierski
*Attorney, Agent, or Firm*—Antonelli, Terry & Wands

[57] ABSTRACT

A wear-resistant metal member comprises a surface that has a sprayed layer consisting essentially of, by weight, 2 to 10% C, 18 to 60% Cr, 0.3 to 20% V, 25% or less Mo, 25% or less W, 10% or less Nb, 10% or less Ti, 10% or less Zr, 10% or less Hf and the balance being Fe in a proportion of 20% or greater. The sprayed layer has a martensite-phase matrix containing carbide particles, nitride particles or carbonitride particles. In addition, the member of the present invention is produced by the steps of: plasma-spraying the above-described metal in a reduced pressure atmosphere; and quenching the thus-sprayed metal layer from a predetermined temperature to form a materisite phase in that layer. In addition, the sprayed metal layer may be subjected to carburizing, nitriding or carbonitriding to form a carburized, nitrided or carbonitrided layer in the sprayed metal layer. The member of the present invention has a high wear resistance and is used as a sliding portion of a valve gear in an internal combustion engine.

37 Claims, 8 Drawing Sheets

25 μm

5μm (SPRAYED IN REDUCED PRESSURE ATMOSPHERE)

HIGH WATER-RESISTANT MEMBER, AND VALVE GEAR USING THE SAME FOR USE IN INTERNAL COMBUSTION ENGINE

BACKGROUND OF THE INVENTION

1. FIELD OF THE INVENTION

The present invention relates generally to a constituent member having a high strength and a high wear resistance and a method of producing the same, as well as a valve gear using the same for use in an internal combustion engine. More particularly, the present invention relates to a composite member composed of a wear-resistant material suitable for use in forming sl:ding members subjected to high loads or impact loads. The invention further relates to a method of producing such a wear-resistant member, and its use.

2. DESCRIPTION OF THE PRIOR ART

In the field of structural components, it is generally unnecessary to ensure that the whole of each structural component is provided with certain properties required for specific purposes. In a typical case, the greater part of a structural component is composed of a relatively inexpensive material, but a specific portion of the surface of the structural component requires particular properties. For instance, a cutting tool is normally constituted by a combination of a hard cutting portion and a remaining portion made of a material which is strong enough not to be deformed or broken by the cutting load. In addition, as the size of such a component increases, a proportion of the part in the component occupied by the portion requiring specific properties is often relatively reduced. It is therefore advantageous, in terms of performance and price, to form such a component by a combination of a base material occupying the greater part of the component and a surface layer made of a material having desired properties. In particular, composite members comprised of a base material coated with a hard surface layer are employed as sliding components of the type which requires a certain level of wear resistance.

Such a composite member for use as a sliding component is described, for example, in Japanese Patent Publication No. 12424/85 which discloses a composite member comprised of a base material which is plasma-sprayed with a powder of high carbon—high Cr cast steel or a mixture of that powder and a powdered self-fluxing alloy. Further, Japanese Patent Publication No. 12425/85 discloses a composite sliding member comprised of a base material which is plasma-sprayed with a powder of high carbon—high Cr cast steel and a powder of Cu alloy. In the process of manufacturing either of these prior-art composite members, however, plasma spraying is effected under atmospheric pressure conditions. Accordingly, it is impossible to achieve satisfactory adhesion of the sprayed material to the base material, as well as a sufficient adhesion strength between individual layers of particles contained in the resultant coating. In addition, no investigation has been made on the density of precipitated hard intermediallic compounds and the degree of dispersion thereof.

Further, Japanese Patent Publication No. 57552/82 discloses a method of using CVD to coat a base material with a layer of a precipitated hard metal alloy composed of a metal halide and carbon, boron or silicon. This method utilizing CVD, however, involves a problem in that the strength of adhesion between the base material and the layer or the toughness of the precipitated layer is reduced because of treatment strains caused by differences in physical values between the base material and the layer coated thereon, since the precipitated layer is present in a single phase. The above Publication further discloses that only the precipitated layer is utilized by taking it out. However, as the size of the precipitated layer increases, it becomes impossible to achieve a sufficient toughness, because the precipitated layer is an intermetallic compound. Also, since heat decomposition of the metal halide is utilized to form the precipitated layer on the base material, the treatment cost per unit area increases due to various factors such as the high production cost of the metal halide and the necessity for post-treatment of a halogenating gas. This limits the kind of components to which this prior art method is applicable.

On the other hand, for a high hardness material (ingot) made by melting, an alloy disclosed in Japanese Patent Publication No. 17069/82 is known as a wear-resistant cutting tool steel. As the content of MC-system carbide is increased, the wear resistance of this alloy is improved. However, if the V content is increased in order to increase the MC-system carbide content, the melting temperature of this alloy rises, thereby making it difficult to produce the alloy. In addition, the specific gravity of the MC-system carbide is lower than that of the melt, so that the MC-system carbide tends to move upward during melting, and this hinders the production of a homogeneous metal structure. Moreover,as the melting temperature rises, the particle size of carbide becomes larger during the crystallization thereof, thereby causing reductions in toughness and in machinability. Therefore, in a melting method, the composition range of the alloy is determined by the conditions governing working, not by the properties of a product, thereby reducing the range of machine design.

It is known that a valve gear incorporated in an internal combustion engine has various sliding surfaces which are maintained in sliding contact with each other, and the sliding surfaces thereof are made of alloy steel or case-hardened steel which is subjected to surface hardening by means of heat treatment. In this case, a thickly hardened layer or a hard sintered material is embedded in a portion of a cam shaft which is in contact with a cam wheel, since that portion requires an extremely high wear resistance. For example, Japanese Patent Application Laid-Open Publication No. 53612/83 discloses a structure in which a Co-based sintered alloy containing carbide is bonded, at the surface of a tappet contacting with a cam, to a body of the tappet made of steel or cast iron through an intermediate layer consisting of Fe-based sintered alloy which was sintered in liquid phase. The valve lifter (called "tappet" in the above Laid-Open Publication) possesses a very good wear resistance, such as scufing resistance, etc. However, in the production of the structure, the Co-based alloy powder used for the surface layer is compacted and then the Fe-based alloy powder to be sintered in liquid phase is compacted thereon, and thereafter they are attached to the body of the valve lifter. Then, the thus-assembled body is heated to a temperature at which the Fe-based sintered alloy becomes liquid phase. Accordingly, in this production process no satisfactory considerations are given to a productivity, a deformation caused by the heating to high temperatures, and an increase in the price incurred by the use of expensive materials such as Co.

On the other hand, Japanese Patent Application Laid-Open Publication No. 214609/83 discloses a valve lifter in which a reduction in the weight is taken into consideration. According to the art disclosed in this Laid-Open Publication the body of the valve lifter is produced from a casting of aluminum, magnesium or other light alloys, and the sliding portion of its surface which is brought into contact with a cam wheel is sprayed with ceramics, tungsten carbide or the like. Accordingly, a reduction in the weight of the body is achieved to some extent, but the wear resistance and the durability of the surface are not sufficiently taken into consideration. In a typical spraying method, particles having a particle size of several μm to several hundreds μm are sprayed onto a base material to form a coating thereon. Accordingly, the bonding strength between the coating and the base material is achieved mechanically, and the strength thereof will be several kg/mm$^2$ at best. Also, the interior of the coating exhibits a laminated structure containing a multiplicity of pores, and thus the bonding strength between individual layers formed by the sprayed particles is weak. Therefore, the phenomenon of pitting may take place under conditions of high-load friction. In addition, the body does not have a sufficient toughness since it is formed from a light alloy casting.

SUMMARY OF THE INVENTION

Object of the Invention

A primary object of the present invention is to provide a wear-resistant member containing a homogeneously distributed, fine compound having a very good wear resistance and a method of producing the same, as well as a valve gear using the same for use in an internal combustion engine.

STATEMENT OF THE INVENTION

A first feature of the present invention resides in a wear-resistant metal member comprising a surface that has a sprayed layer consisting essentially of, by weight, 2 to 10% C, 18 to 60% Cr, 0.3 to 20% V, and the balance being Fe in a proportion of 20% or greater, the sprayed layer having a martensite-phase matrix containing carbide particles, nitride particles or carbonitride particles or having, in addition thereto, a surface provided with a carburized layer, a nitride layer or a carbonitrided layer.

In accordance with the first feature of the invention, the areal ratio of the carbide or carbonitride particles ranges from 25 to 95%, and these particles are formed mainly in such a state that numerous particles are bonded together, thereby providing a high wear resistance.

A second feature of the present invention resides in a wear-resistant metal member comprising a surface that has a sprayed layer consisting essentially of, by weight, 2 to 10% C, 18 to 60% Cr, 0.3 to 20% V, 25% or less Mo, 25% or less W, 10% or less Nb, 10% or less Ti, 10% or less Zr, 10% or less Hf and the balance being Fe in a proportion of 20% or greater, the sprayed layer having a martensite-phase matrix containing carbide particles, nitride particles or carbonitrile particles or having, in addition thereto, a surface provided with a carburized layer, a nitrided layer or a carbonitrided layer, wherein the areal ratio and the state of bonded particles are the same as described above.

A third feature of the present invention resides in a method of producing a wear-resistant metal member, comprising the steps of spraying an alloy onto a surface of a metal member in a reduced pressure atmosphere by plasma spraying to form a sprayed layer on the surface, the alloy consisting essentially of, by weight, 2 to 10% C, 18 to 60% Cr, 0.3 to 20% V, 25% or less Mo, 25% or less W, 10% or less Nb, 10% or less Ti, 10% or less Zr, 10% or less Hf and the balance being Fe in a proportion of 20% or greater; subjecting the sprayed layer to a hardening treatment consisting of heating at a predetermined temperature followed by quenching; and then subjecting the same to a tempering treatment.

The above-described method of the present invention may further include the step of effecting a carburizing, nitriding or carbonitriding treatment prior to the aforesaid hardening treatment and the step of effecting a plastic working prior to the carburizing, nitriding or carbonitriding treatment.

A fourth feature of the present invention resides in a wear-resistant sliding mechanism comprising metal members which are maintained in sliding contact with each other, at least one of the metal members having a sliding surface provided with a sprayed layer consisting essentially of, by weight, 2 to 10% C, 18 to 60% Cr, 0.3 to 20% V, 25% or less Mo, 25% or less W, 10% or less Nb, 10% or less Ti, 10% or less Zr, 10% or less Hf and the balance being Fe in a proportion of 20% or greater, the sprayed layer having a martensite-phase matrix containing carbide particles, nitride particles or carbonitride particles and further having a surface provided with a carburized layer, a nitrided layer or a carbonitrided layer.

A fifth feature of the present invention resides in a valve gear for use in an internal combustion engine which is adapted to employ a thrust generated by the rotation of a cam to cause a valve stem to reciprocally move, the valve gear comprising metal members which are maintained in sliding contact with each other, at least one of the metal members having a sliding surface provided with a sprayed layer consisting essentially of, by weight, 2 to 10% C, 18 to 60% Cr, 0.3 to 20% V, 25% or less Mo, 25% or less W, 10% or less Nb, 10% or less Ti, 10% or less Zr, 10% or less Hf and the balance being Fe in a proportion of 20% or greater, the sprayed layer having a martensite-phase matrix containing carbide particles, nitride particles or carbonitride particles and further having a surface provided with a carburized layer, a nitrided layer or a carbonitrided layer. In consequence, it is possible to achieve structural members which are reduced in size but excel in toughness, pitting resistance, scuffing resistance and wear resistance.

In general, in order to improve the load resistance and wear resistance of a sliding member, it is desirable that the surface layer of the sliding member have a structure in which a matrix phase having high toughness and a hard phase are firmly bonded together and, in addition, in which the hard compound is fine and its areal ratio is large. Accordingly, it is desirable that a large amount of a fine compound, such as a carbide, a nitride or a carbonitride, is crystallized in a surface layer, that is, the hard coating. However, if the amount of carbon added is raised to increase the carbide content, the melting temperature of the material rises, the carbide becomes coarse, and further segregation or the like occurs because of differences in the specific gravity, thereby reducing the wear resistance and load resistance.

The above-described problems are solved by the wear-resistant member of the present invention. In the present invention, with respect to the fragmentary hard compound, its size in width is limited to 3 μm or less and its areal ratio to 25 to 90%. The reason therefor will be described below. In general, if fragmentary hard compounds having a widthwise size of 3 μm or greater occupy the greater part of the structure of the wear-resistant member, the surface area of each of the compounds responsible for bonding is reduced when the compounds have a complicated shape, as in the case of the fragmentary compounds of the present invention, so that the bonding between the hard compounds and the matrix phase becomes insufficient. Accordingly, if such a member is employed as a high hardness member, the compounds easily exfoliate during finishing or use. Also, if each of the compounds has a widthwise size of 3 μm or greater with an areal ratio of 25% or less, the area of the matrix which is softer than the compound increases. As a result, cracks occur because of the deformation of the matrix, or the compounds partially exfoliate or drop because of wear in the surrounding phase, so that the wear resistance of the member is reduced. In particular, the compounds exfoliated during use get caught in the clearance between surfaces of components which are maintained in frictional contact with each other, thereby scuffin the surfaces. Alternatively, the exfoliated compounds act as an abrasive and thus accelerate the wear.

It is to be noted that the nitride and the carbonitride can be produced by forming a sprayed layer in a reduced pressure atmosphere.

The following is a description of the composition of the surface layer.

Carbon is a primary component which combines with other elements to form a simple or composite carbide to improve wear resistance, and is intimately associated with carbide formers. As the amount of the carbide formers added is increased, the content of hard carbide can be increased. When the amount of the carbon added is 2% or less, it becomes impossible to obtain satisfactory wear resistance which is indispensable for a high hardness member. As the content of carbon is increased, the amount of the carbide that is crystallized increases to improve the hardness of the surface layer. However, if the amount of the carbon added is 10% or greater, free carbon appears and this causes the workability during melting, hot working, cold working, grinding or the like to be lowered and, in addition, the hard layer becomes brittle since pores are produced therein. In terms of hardness, spraying workability, toughness and so forth, the amount of the carbon to be added is preferably 2.5 to 5%, more preferably 2.5 to 3.5%. It is desirable that 80% of the content of the carbon forms a carbide. When carbon exists in solid solution state or graphite, wear resistance is significantly reduced and the brittleness of a coating remarkably increases. Also, the content of oxygen in the coating is an important factor in terms of the coating toughness. As the oxygen content increases, an oxide precipitates to make the coating brittle. The critical value of the oxygen content is about 1500 ppm and, when this value is exceeded, the toughness is significantly reduced to cause the phenomenon of pitting. Also, it is desirable that the coating and the base material are bonded together by forming a diffused layer therebetween in order to achieve a sufficient durability. The thickness of the coating is also important for durability and reliability. For example, if the coating thickness is less than 0.2 mm, the wear resistance of the coating is reduced under the influence of the base material when exposed to friction under high-load conditions, and further after the coating has become worn the degree of wear increases. In order to improve the toughness of the coating, it is desirable that fine carbide is uniformly distributed. More preferably, the content of carbon and the amount of distributed carbide should increase toward the surface of the coating.

Cr is an element which forms a carbide and improves the ability to heat-treat the matrix, wear resistance and load resistance, and which has a specific gravity smaller than the matrix metal and is economically advantageous. If the amount of Cr added is less than 18%, it is impossible to obtain a satisfactory effect, although its effectiveness may of course depend upon other components which coexist with Cr. As the Cr content increases, the hardenability increases. However, if the Cr content exceeds 60%, workability is greatly reduced and it thus becomes difficult to form a homogeneous layer and thus the hard layer becomes embrittled because of pores produced therein. In particular, the amount of Cr added is preferably 25 to 35% from the viewpoint of homogeneous distribution of carbide, spraying workability and toughness.

V is a significantly effective component since it forms a carbide and acts to finely divide and toughen the crystal grains of a matrix. In general, a carbide containing V is extremely hard, and a slight amount of V can produce a satisfactory effect in finely dividing the crystal grains and in hardening by nitriding. However, in the case of a high alloy steel system as in the present invention, when the V content is 0.3% or greater a significant effect is achieved. As the V content increases, the content of a carbide increases so that wear resistance increases. The upper limit of the V content is 20% since the effect of V is saturated at about 20%. Nb and Ta are known as elements of the same group, and they are also effective in forming a carbide, a nitride and a carbonitride to harden the crystal grains, thereby improving the wear resistance. A slight amount of either of Nb and Ta produces a satisfactory effect upon diffusion heat treatment, and the effect of each of them is saturated at 15%. In particular, the amount of either of Nb and Ta is preferably 3 to 11% in terms of homogeneous distribution of carbide, improved hardness of matrix, spraying workability and toughness.

Mo and W form $M_6C$ and MC type carbides to improve wear resistance. As the added amount of either of these elements increases, the amount of carbide increases and thus wear resistance is improved. When the amount of either of Mo and W reaches 25%, the effect thereof is saturated. In particular, the amount of either of Mo and W is preferably 3 to 10% in terms of homogeneous distribution of carbide, spraying workability and toughness.

Ti, Zr, and Hf of the 4A group act as carbide former or nitride former, and are components effective for hardening. As the amount of each of them added is increased, the effect for hardening is improved. However, when the amount to be added exceeds 10%, workability is reduced, and the surface layer tends to become brittle. In particular, the amount of each of these elements is preferably 0.5 to 3% in terms of homogeneous distribution of carbide, spraying workability and toughness since these elements strongly act as carbide formers.

In addition, Si and Mn may respectively be contained as a deoxidizer in the amount of 2% or less.

Fe becomes a matrix and forms a martensite-phase matrix to improve the wear resistance. Fe is therefor added in the amount of 20% or greater. Since the wear resistance is obtained by hard substances such as carbide particles, nitride particles or carbonitride particles, it is necessary that the matrix contains these particles in large amounts. Accordingly, in order to obtain a high wear resistance, the Fe content is preferably 70% or less, more preferably 40 to 60%.

The thickness of a hard coating serving as a surface layer is preferably 30 μm or greater. A hard coating having a thickness of less than 30 μm exfoliates during finishing or use, and when it is used under high-load conditions its withstanding pressure is reduced and thus causes deformation of the base material.

In order to form the surface layer serving as the above-described hard coating on the surface of the base material, a melt of the alloy having the composition of the surface layer is atomized and sprayed directly onto the base material, or it is once powdered and the powder is sprayed onto the base material to form a coating. In either case, the surface layer is formed in a reduced pressure atmosphere. For example, if the spraying is carried out in the atmosphere in the same manner as in the prior art, a sprayed powder which is heated by a heating source reacts with an oxygen or nitrogen gas in the air to form a reaction product. Before the reaction product adheres to the base material, the reaction product solidifies or the temperature thereof approaches its solidification point since the reaction product has a high melting temperature. When a coating serving as the surface layer is formed under these conditions, the particles of the powder used are flatly crushed by an impact caused when the powder adheres to the base material, and the thus-crushed particles are superimposed in layers within the coating. Thus, the coating includes a layer containing superimposed particles between which undesired defects are present such as pores and oxides. Therefore, the coating becomes very brittle. To prevent the formation of such a coating, plasma spraying is performed in a reduced pressure atmosphere. In accordance with this plasma spraying, no defects such as oxide films or pores are formed between individual particles, so that adjacent particles fuse together and precipitate as fine compounds, thereby forming a dense hard layer.

It is preferable that the above-described spraying in reduced pressure is performed in a non-oxidizing gas and under a reduced pressure of 100 Torr or less. Ar, He, $H_2$, $N_2$ and so forth may be employed as the atmosphere. However, in the as-sprayed state, since the diffusion between adjacent individual particles in the coating as well as between the base material and the coating is insufficient, the mechanical strength of the coating is low. For this reason, in accordance with the invention, a mutual diffusion at a boundary between the surface layer and the base material is carried out by a heat treatment to thereby realize high strength and toughness. If this heat treatment is carried out in at least one of carburizing, nitriding and carbonitriding atmospheres, it is possible to more certainly and rapidly effect the mutual diffusion of atoms between adjacent particles as well as between the coating and the base material, and to remove, by the diffusion of atoms from the atmosphere, the impurities between particles which are flatly adhered to the base material as well as to form a fine compound which hardens the coating. Therefore, no local wear occurs and a high wear resistance can be achieved over the whole of the coating. In addition, in order to improve toughness, it is also effective to carry out plastic working as required prior to heat treatment. In this case, if a working ratio is 30% or greater in terms of reduction of area, a remarkable effect is achieved. Incidentally, although the base material is softened by spraying, it can be hardened by carburizing and nitriding.

It is to be noted that, as the amount of carbon added is increased in order to increase the content of a carbide or the like, the temperature at which a material is melted rises and further the carbide grows coarsely. It therefore becomes difficult to effectively produce a homogeneous material. A desirable method of solving this problem is as follows. In the state of a material, the carbon content is limited to some extent and the structure of the material is prepared such as to contain large amounts of elements having a low level of free energy for forming a carbide, a nitride and a boride, and after the material has been formed into a constituent part, at least one of carbon, nitrogen and boron is diffused into the surface of the constituent part to precipitate a compound thereof.

It is to be noted that, after plasma spraying, the surface layer is spontaneously quenched, with the result that a supersaturated solid solution phase increases because of the effect of quenching. Accordingly, a fine compound is precipitated by a subsequent heat treatment. After the heat treatment, the surface layer is toughened with a high hardness in a quenching-tempering step. Also, the amount of precipitates can be controlled by controlling the composition of materials, the temperature of heat treatment and the amount and ratio of atoms to be diffused.

In accordance with the present invention, unlike prior art melting and sintering methods, because the components having a low level of free energy for forming a carbide, a nitride or a carbonitride exist in a solid solution state in the surface of a base material made of a material having a high toughness and further that a material for forming a carbide is plasma-sprayed onto the surface in a reduced pressure atmosphere followed by heat treatment, it is possible to obtain a very tough composite material which is excellent in wear resistance and has an extremely hard surface layer with a very fine and homogeneous phase and in which the adhesion between the surface layer and the base material as well as the adhesion between the particles in the surface layer are excellent.

Such a surface layer may be formed only in a required area of the base-material surface by spraying. In a case where a wear-resistant material is produced by a production process employing a conventional melting method, the rate at which the material is cooled during forging is limited when the forged material reaches a certain size, so that the precipitated phase becomes coarsened because of the thermal equilibrium during this cooling, thereby determining the composition range of the material. On the other hand, in the present invention, since the wear-resistant phase is formed using powders having a particle size of 44 μm at the maximum and it is rapidly quenched, it is possible to significantly widen the design range of the material.

DESCRIPTION OF THE PREFERRED EMBODIMENTS

Example 1

An alloy steel having the composition (wt. %) shown in Table 1 was melted, and from the melt a powder having a particle size of 10 to 44 μm was prepared by a vacuum atomizing method. The thus-prepared powder was plasma-sprayed in a reduced pressure atmosphere to a thickness of about 30 μm onto the surface of a base material preheated to about 500° C., the base material being SCM 415 steel (0.4% C–1% Cr–0.25% Mo steel). The atmosphere used was Ar under a reduced pressure of 50 Torr. The plasma gas used was a mixture of Ar and $H_2$, and the plasma current used was 800 A. The temperature of the base material during spraying was about 800° to 900° C., and the period of spraying was about 10 minutes. Subsequently, the thus-treated material was heated at 930° C. for 30 minutes followed by oil-quenching, and was then tempered at 170° C. for 120 minutes. The conditions of such quenching and tempering were suitable for the heat treatment of the alloy base material. In this manner, Samples A to J shown in Table 1 were prepared. In Table 1, Samples F to J are Comparative Samples. The results of evaluation based on the observation of the surface of each sample are listed in the column of workability in Table 1. In Table 1, the samples marked with "o" have a homogeneous coating and may be utilized as structural members having a smooth surface. The samples marked with "x" have a porous and brittle surface and are not suitable for use as the surface layer of a structural member. Therefore, since the latter samples were not able to be employed in wear tests, they were produced, together with Sample SKD1, by melting and were then subjected to the wear tests.

TABLE 1

| | | C | Cr | V | Mo | W | Nb | Ti | Others | Fe | Workability |
|---|---|---|---|---|---|---|---|---|---|---|---|
| Sample of Invention | A | 3.5 | 30 | 7 | — | 3 | — | 1 | — | 55.5 | o |
| | B | 2.5 | 20 | 5 | 10 | — | — | — | Zr 2.5 | 60 | o |
| | C | 8 | 35 | 11 | 3 | 5 | — | — | — | 38 | o |
| | D | 5 | 42 | 5 | 3 | 5 | — | — | — | 40 | o |
| | E | 6 | 55 | 5 | 3 | 5 | 1 | 1 | Hf 2 | 22 | o |
| Comparative Sample | F | 1.5 | 40 | 32 | — | — | — | — | — | 26.5 | x |
| | G | 2.5 | 65 | 5 | — | — | — | — | — | 27.5 | x |
| | H | 3 | 25 | 5 | 35 | 3 | — | — | — | 29 | x |
| | I | 3 | 25 | 7 | 3 | 30 | — | — | — | 32 | x |
| | J | 3 | 30 | 7 | — | — | — | 20 | — | 40 | x |
| | SKD1 | 2 | 13 | — | — | — | — | — | Si 0.2 Mn 0.4 | 84.4 | — |

Figure 1:
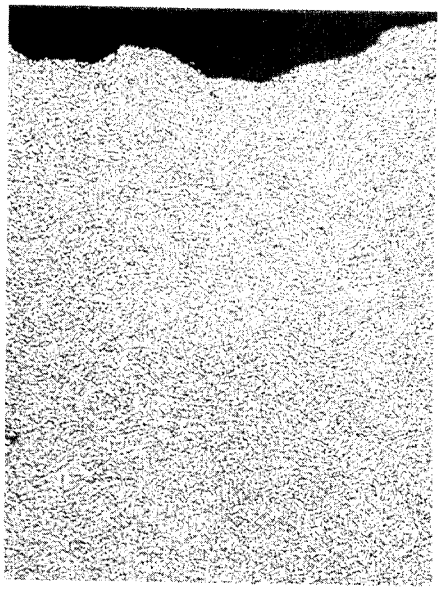
FIG. 1 is a micrograph showing the metal structure, in cross section, of the member according to an embodiment of the present invention.
Figure 2:
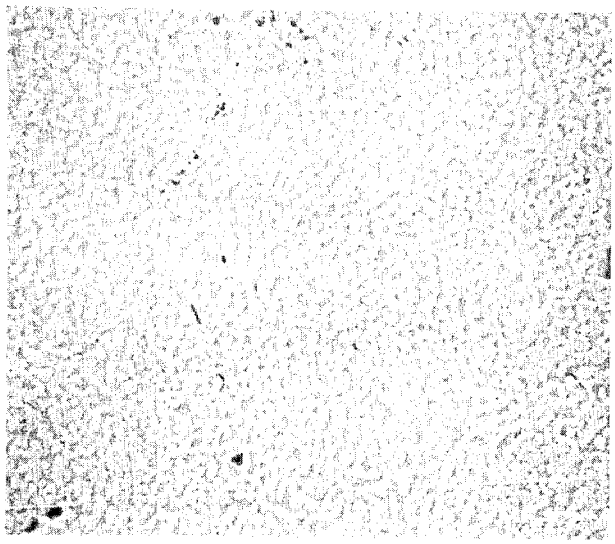
FIG. 2 is an electron micrograph showing the metal structure, in cross section, of the member according to an embodiment of the present invention.

FIG. 1 is a micrograph, in cross section, of Sample A, as a typical example, in accordance with the present invention. FIG. 2 is a scanning electron micrograph (magnification of 4,000) showing the metal structure, in cross section, of a hard coating of Sample A. As can be seen from these micrographs, notwithstanding the fact that the carbon content is high, an extremely fine structure is achieved. In these micrographs, the phase in which particles are finely and uniformly distributed in the form of blackish gray fragments corresponds to a carbide which is an intermetallic compound. The particles of the carbide phase have a widthwise grain size of 3 μm or less, the areal ratio of the particles is about 70% or greater, and the particles are distributed in the martensite matrix phase (a whitish gray portion in the micrograph) in the form of a wave as a whole. In addition, it will be seen that the distance between adjacent particles of the carbide phase is smaller in the direction normal to the longitudinal direction of the wave than in the longitudinal direction of the same. The hardness of.a hard layer constituting the coating is 1200 to 1300 Hv.

Further, after Sample SKD1 had been subjected to heat treatment under the same conditions, its microstructure was observed. As compared with the microstructures shown in FIGS. 1 and 2 of Sample A of the present invention the carbide in Sample SKD1 was coarse and non-uniformly distributed. The hardness of Sample SKD1 was about 830 Hv.

Figure 3:
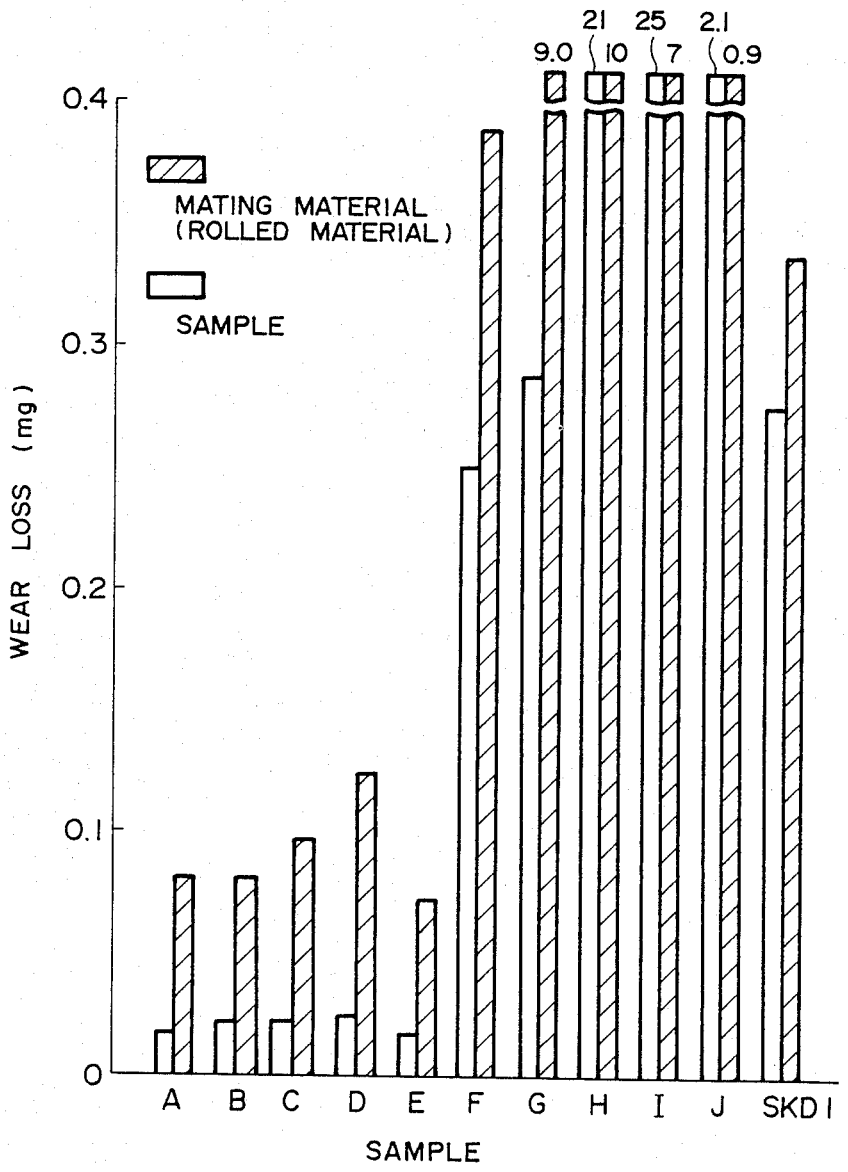
FIGS. 3 and 4 are graphs each showing the comparison of the wear losses of samples which were subjected to sliding wear tests.

FIG. 3 is a graph of the results of the wear tests performed on the aforesaid Samples A to J. A mating material to which Samples A to J were brought into sliding contact was a rolled material of SKD1 having a hardness of 840 Hv, and the wear tests were performed under lubrication conditions employing a turbine oil. The load was 100 kgf/cm$^2$, and the number of repetition was $10^3$. Each of the samples had a sprayed layer of 10 mm in width and 50 mm in length, and the material produced by melting had a trapezoidal shape in cross section with a predetermined thickness. The mating material had a diameter of 8 mm and each of the samples was slided over a distance of 40 mm on the mating material. It will be readily understood from FIG. 3 that Samples A to E of the present invention hardly wear and excel in wear resistance. The wear loss of each of the samples of the present invention was about 0.006 mg/cm$^2$ or less.

Example 2

Samples in Example 2 were prepared in the following manner. An alloy steel (a hard material) having the composition (wt. %) shown in Table 2 was melted, and from the melt a powder having a grain size of 10 to 44 μm was prepared by a vacuum atomizing method. In the same manner as in Example 1, the thus-prepared powder was plasma-sprayed in a reduced pressure atmosphere to a thickness of about 30 μm onto the surface of a base material which was S45C carbon steel specified in the Japanese Industrial Standards. Subsequently, the thus-treated material was carburized in a plasma atmosphere. The carburizing conditions were 1000? C. and 20 minutes, and $CH_4$ was employed as a carburizing gas.

TABLE 2

| | C | Cr | V | Mo | W | Nb | Ti | Hf or Zr | Workability |
|---|---|---|---|---|---|---|---|---|---|
| K | 3 | 32 | 7 | — | 3 | — | 1 | — | o |
| L | 2.5 | 25 | 5 | 10 | — | — | — | 2.5 | o |
| M | 5 | 23 | 11 | 3 | 5 | — | — | — | o |
| N | 1 | 30 | 5 | 3 | 5 | — | — | — | o |
| O | 5 | 30 | 32 | — | — | — | — | — | x |
| P | 3.5 | 25 | 5 | 3 | 5 | 1 | 1 | 2 | o |
| Q | 2.5 | 50 | 5 | — | — | — | — | — | x |
| H | 3 | 25 | 5 | 35 | 3 | — | — | — | x |
| I | 3 | 25 | 7 | 3 | 30 | — | — | — | x |
| J | 3 | 30 | 7 | — | — | — | 20 | — | x |

The results of evaluation based on the observation of the surface of each sample are listed in the column of workability in Table 2. In Table 2, the samples marked with "o" have a homogeneous coating and are applicable as a structural member having a smooth surface. In Table 2, Samples O, Q, H, I, and J marked with "x" have a pourous and brittle surface and are not suitable for use as the surface layer of a structural member. Therefore, by the same process used in Example 1, materials of these samples were produced by melting. As a typical example, the metal structure, in cross section, of Sample K was observed through a microscope. Notwithstanding the fact that the content of carbon was high, the structure of the resultant carbide was extremely fine. The particle size of the carbide was finer than that of the as-sprayed powder, and the hardness of the surface of the coating was 1200 to 1300 Hv while the hardness of the portion of the coating near the boundary of the base material was 850 Hv. Carburizing was effected over the whole of the sprayed layer and the base material. In consequence, the base material was also strengthened. By way of reference, a high carbon-high chromium steel SKD1 (2% C–13% Cr) produced by a conventional melting method was employed as a comparative material and was carbonitrided. The structure of this material was also observed through a microscope. The carbonitrides in the structure were coarse and non-uniform as compared with the structure of the material according to the present invention. Further, the hardness of SKD1 was about 830 Hv, and no substantial effect of carbonitriding was obtained.

Figure 4:
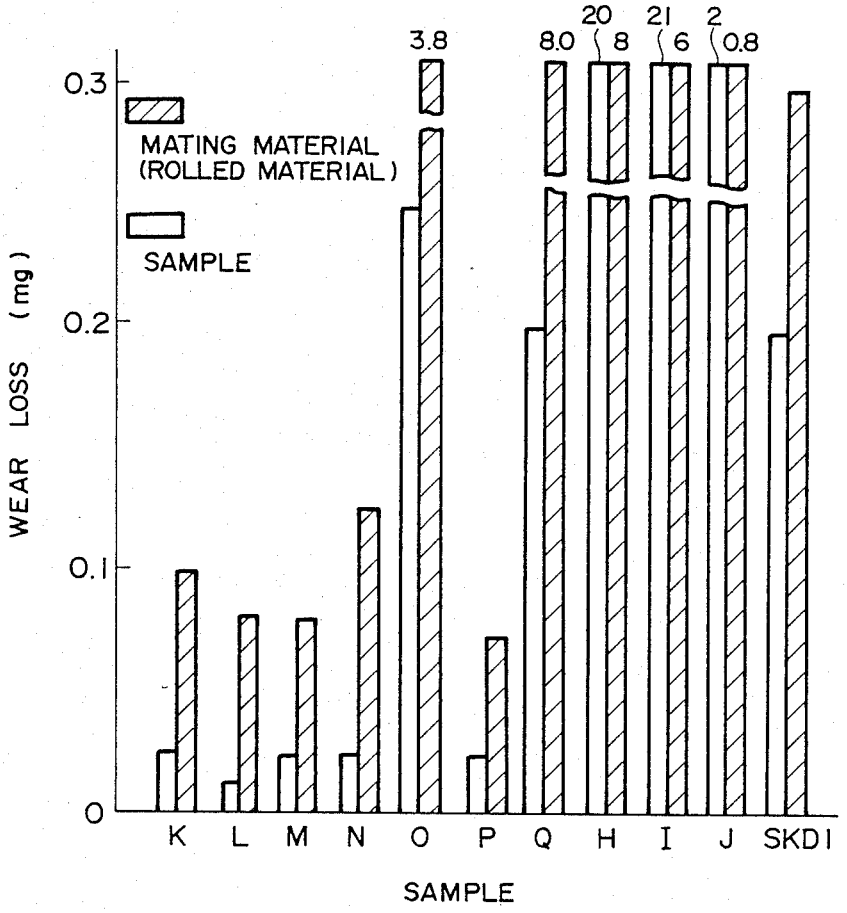

FIG. 4 is a graph of the results of the wear tests. A mating material to which each sample was brought into sliding contact was the same rolled material having a hardness of 840 Hv as in Example 1, and each of the samples was subjected to wear tests under lubrication conditions employing a turbine oil. Each testing condition was the same as in Example 1. As clearly shown in FIG. 4, the wear loss of each of the comparative samples is large, whereas the wear loss of each of the samples of the material of the present invention is about 0.03 mg or less and no substantial wear takes place. Therefore, it will be understood that the samples of the material of the present invention in Example 2 show the wear loss to a degree similar to that in Example 1 and excel in wear resistance. Since the materials of the present invention in Example 2 contained a fine carbide, they exhibited a homogeneous wear loss as a whole and no excessive local wear was observed.

Also, after plasma spraying, the surface layer was subjected to plastic working and was subjected to the same treatment as described above. The wear resistance of the surface layer did not change. However, it was found from the observation of the microstructure that the pores which had been present when no plastic working was effected substantially disappeared, so that the plastic working was very effective in improving the toughness.

Next, the same samples were subjected to nitriding heat treatment at 550° C. for 5 hours. The hardness of each of the thus-treated samples was 1300 to 1500 Hv, and was higher than the hardness of a carbonitrided sample. The wear losses of these samples were the same as those shown in FIG. 4, and the resultant wear resistance was significantly high.

Example 3

Figure 5:
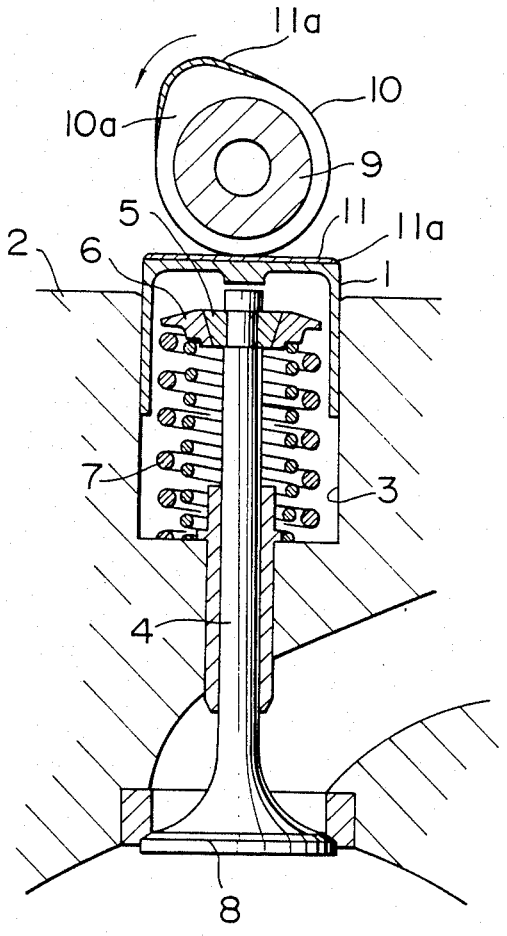
FIG. 5 is a cross-sectional view of the essential portion of a valve lifter and a portion of an internal combustion engine.

FIG. 5 shows in section an essential portion of a valve lifter for a valve for use in an internal combustion engine. A cylindrical valve lifter 1 for a valve is inserted into a valve-lifter guide bore 3 which is formed in a portion of a cylinder head 2. A valve stem 4 is retained by a valve guide 5 in the center of the guide bore 3 and extends through the cylinder head 2. A coiled valve spring 7 is disposed between the bottom of the guide bore 3 and a retainer 6 fixed to one end of the valve stem 4 by a cotter 5. The spring 7 normally urges the valve stem 4 to move in the direction of a cam shaft 9 to maintain the valve 8 in a closed state. A cam 10 fixed to the cam shaft 9 is pressed into contact with the center of a head 11 of the valve lifter 1. A diffused layer 11a having a thickness of 0.1 mm or greater is formed over the top of the head 11.

A base body of the valve lifter having a shape shown in FIG. 5 was prepared by cold forging, employing a material called SCM 415. After the surfaces of the base body had been subjected to grid blasting, a hard coating was formed on each of the surfaces by plasma spraying and the durability of the surfaces were compared. One plasma spraying was carried out in the atmosphere while another was carried out in a reduced pressure atmosphere. The latter spraying was effected by making a special spraying chamber, reducing the inner pressure of the chamber to 0.1 Torr or less by evacuation, supplying argon gas to the chamber, and maintaining the inner pressure at 50 Torr. Plasma for spraying was formed by argon and oxygen gases. The current was about 600 A. The powders to be sprayed has a particle size of 10 to 44 μm and their compositions were: (1) 2% carbon–20% chromium steel; (2) 5% carbon–25% chromium–5% vanadium steel; (3) 4.2% carbon–20% chromium–3% vanadium–2% tungsten steel; (4) 5% carbon–20% chromium–2% vanadium–1% niobium steel; (5) 3.5% carbon–30% chromium–3% vanadium–0.5% molybdenum–0.5% niobium steel; and (6) 3% carbon–22% chromium–3% vanadium steel. Each of these powders was produced by a vacuum atomizing method, and was plasma-sprayed to a thickness of 0.5 mm onto the head of the valve lifter as shown in FIG. 5. Some of the valve lifters were compared for durability in their as-sprayed state. Subsequently, the sprayed valve lifters were subjected to the following heat treatment: (1) high-temperature carburizing at 1,000° C. for 15 minutes followed by quenching, similarly to Example 2 or (2) vacuum heat treatment at 1,000° C. for 15 minutes. The oxygen content in the resultant coating changed depending on the spraying method and the heat treatment. More specifically, in each of the coatings obtained by the conventional spraying in the atmosphere, the oxygen content was 5,000 ppm or greater, and although there was a tendency that the oxygen content is somewhat reduced by a subsequent heat treatment no significant reduction was observed. Next, in each of the coatings obtained by spraying in the reduced pressure atmosphere, the oxygen content was 1,000 to 4,000 ppm in its as-sprayed state, but it was reduced to 1,000 ppm or less after being subjected to the carburizing followed by quenching and to 1,500 ppm or less after being subjected to the vacuum heat treatment. The hardness of the surface in each of the coatings obtained by spraying in the atmosphere was 400 to 750 Hv in its as-sprayed state and thus its dispersion was large. This dispersion was not made homogeneous by the heat treatment. Next, the hardness of the surface in each of the coatings obtained by spraying in the reduced pressure atmosphere was 500 to 970 Hv in its as-sprayed state and thus its dispersion was large. However, when it was subsequently subjected to the carburizing followed by quenching, the hardness became 800 to 1,000 Hv and thus the dispersion in hardness became small.

Figure 6:
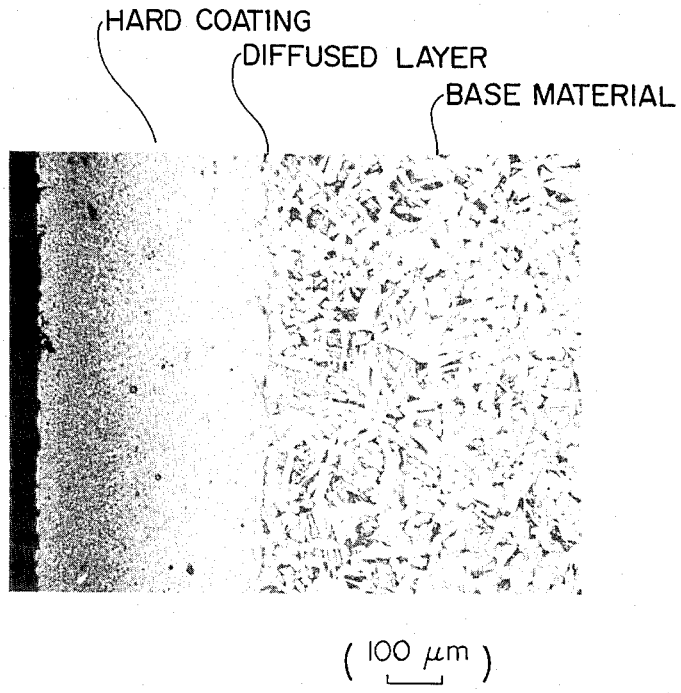
FIG. 6 is a micrograph showing on an enlarged scale the essential portion of a portion formed by spraying in a reduced pressure atmosphere.
Figure 7:
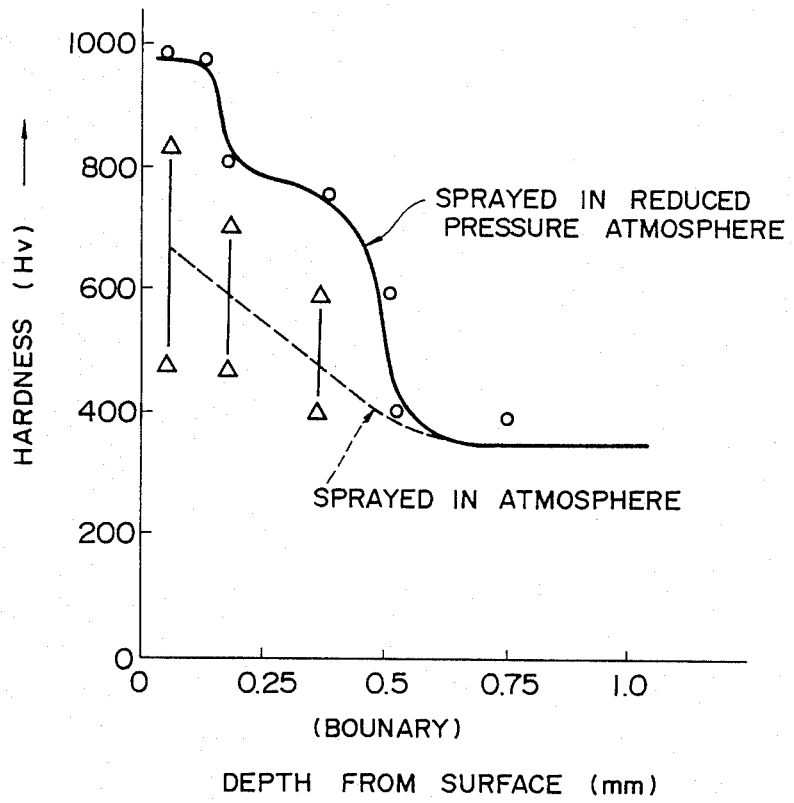
FIG. 7 is a graph showing the comparison of the hardnesses realized by spraying in a reduced pressure atmosphere and spraying in the atmosphere.

FIG. 6 shows a microstructure at the boundary between the coating and the base material. FIG. 7 is a graph showing the distribution of the hardness in the material having a sprayed coating subjected to carburizing followed by quenching of the aforesaid composition (1). A larger number of oxide pores were present n the coating obtained by spraying in the atmosphere in comparison with the coating obtained by spraying in the reduced pressure atmosphere. The oxide pores were hardly changed by a subsequent heat treatment, and were a cause of embrittlement. The durabilities of the respective products having the sprayed coating were compared with one another, and it was found that the one carburized after spraying in the reduced pressure atmosphere exhibited the maximum durability. The product having the coating obtained by spraying in the atmosphere exhibited in wear tests a pitting phenomenon in the as-sprayed state and in the heat-treated state after a short period of time, and its durability was about ⅓ of the aforesaid maximum durability. The durability of the product having the coating obtained by spraying in the reduced pressure atmosphere in the as-sprayed state was about ½ to 4/5 of that of the product carburized after spraying. In some of the products the coating exfoliated from the base material during long-time repetition of wear tests. The durability of the product having the coating obtained by spraying in the reduced pressure atmosphere and subjected to the vacuum heat treatment was ¾ to 1.0 of that of the product having the coating obtained by spraying in the reduced pressure atmosphere and subjected to the carburizing. The former product wore in its surface but no exfoliation of the coating was observed. When a cross section of this product was observed through a microscope, a diffused layer was formed between the base material and the coating. In case of the product having the coating obtained by spraying in the atmosphere, such a diffused layer was not clearly observed when it was subsequently heat-treated.

Example 4

In the same manner as in Example 2, the head 11 of the valve lifter 1 was plasma-sprayed in a reduced pressure atmosphere and was carburized at 1000° C. for 15 minutes followed by quenching. The compositions of the coating were: (1) 0.3% carbon–4% chromium–0.5% vanadium steel; (2) 1.5% carbon–20% chromium–8% vanadium steel; and (3) 12% carbon–30% chromium steel. Powders were prepared by a vacuum atomizing method and their particle size was adjusted to 10 to 44 μm. However, for the above composition (1) a powder to be sprayed was unable to be produced. The thickness of the sprayed coating was 0.5 mm. The durability of the coating having the above composition (1) was about ¾ of that of the coating having the above composition (2).

Although the hard coating **11*a* is formed by spraying over the head 11 of the valve lifter 1, the hard coating 11*a* may additionally be formed over a sliding portion 10*a* of the cam 10 subjected to the highest pressure as shown in FIG. 5 or over the entire circumference of the cam 10**. Of course, such a hard coating may be formed as required over both or either of the sliding surfaces.

Figure 8:
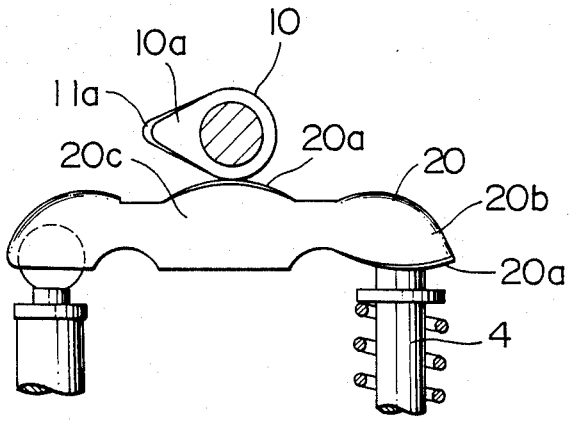
FIG. 8 is a fragmentary front elevation, in cross section, of a valve gear according to another embodiment of the present invention.

FIG. 8 shows another embodiment. As illustrated, a hard coating **20*a* is formed over a surface 20*b* of a locker arm 20 in contact with one end of the valve stem 4 as well as a rear surface 20*c* in contact with the circumference of the cam 10. The hard coatings 20*a* and the hard coating 11*a* over the sliding portion 10*a* of the cam 10** cooperate with one another in improving the wear resistance of the sliding portions of the valve mechanism.

Figure 9:
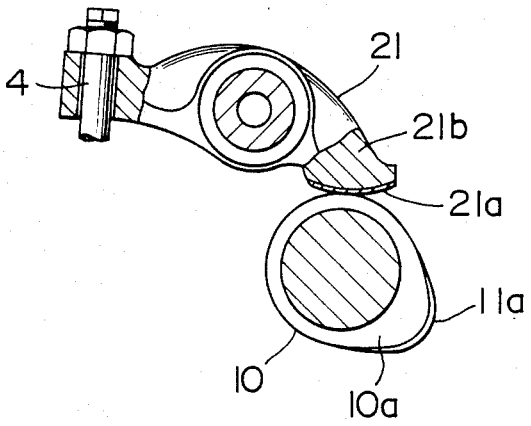
FIG. 9 is a fragmentary front elevation, in cross section, of a valve gear according to still another embodiment of the present invention.

FIG. 9 shows still another embodiment, wherein one end of the valve stem 4 is fixed to one end of a locker arm 21, and a hard coating **21*a* is formed over a sliding portion 21*b* of the locker arm 21 while the hard coating 11*a* is formed over the sliding portion 10*a* of the cam 10**. These coatings may be formed as required over both or either of the surfaces which are brought into sliding contact with each other.

What is claimed is:

1. A wear-resistant metal member comprising a metal substrate having a surface and a hardened and tempered sprayed layer formed on said surface, the sprayed layer consisting essentially of, by weight, 2 to 10% C, 18 to 60% Cr, 0.3 to 20% V, 25% or less Mo, 25% or less W, 10% or less Nb, 10% or less Ti, 10% or less Zr, 10% or less Hf and the balance being Fe in a proportion of 20% or greater, said sprayed layer having a surface hardness of 1000 Hv or greater and having a martensite-phase matrix containing at least carbide particles with a width of 3 m or less and an areal ratio of 25 to 90%.

2. A wear resistant metal member according to claim 1, wherein said martensite-phase matrix contains carbide particles and at least one of nitride particles or carbonitride particles.

3. A wear-resistant metal member according claim 1, wherein said sprayed layer has a surface hardness of 1200 Hv or greater.

4. A wear resistant metal member comprising a metal substrate having a surface and a hardened and tempered sprayed layer formed on said surface, the sprayed layer consisting essentially of, by weight, 2 to 10% C, 18 to 60% Cr, 0.3 to 20% V, 25% or less Mo, 25% or less W, 10% or less Nb, 10% or less Ti, 10% or less Zr, 10% or less Hf and the balance being Fe in a proportion of 20% or greater, said sprayed layer having a surface hardness of 1000 or greater and having a martenside-phase matrix containing at least carbide particles with a width of 3 μm or less and an areal ratio of 25 to 90% and wherein numerous carbide particles are bonded together.

5. A wear-resistant metal member according to claim 4, wherein said martensite-phase matrix contains carbide particles and at least one of nitride particles or carbonitride particles.

6. A wear-resistant metal member according to claim 4, wherein said sprayed layer has a surface hardness of 1200 Hv or greater.

7. A wear-resistant metal member comprising a metal substrate having a surface and a hardened and tempered sprayed layer formed on said surface, the sprayed layer consisting essentially of, by weight, 2 to 10% C, 18 to 60% Cr, 0.3 to 20% V, 25% or less Mo, 25% or less W, 10% or less Nb, 10% or less Ti, 10% or less Zr, 10% or less Hf and the balance being Fe in a proportion of 20% or greater, said sprayed layer having a surface hardness of 1000 Hv or greater and having a martensite-phase matrix containing at least carbide particles with a width of 3 mm or less and an areal ratio of 25 to 90% and said sprayed layer further having a surface provided with a carburized layer, a nitrided layer or a carbonitrided layer.

8. A wear-resistant metal member according to claim 7, wherein said martensite-phase matrix contains carbide particles and at least one of nitride particles or carbonitride particles.

9. A wear-resistant metal member according to claim 7, wherein said sprayed layer has a surface hardness of 1200 Hv or greater.

10. A wear-resistant metal member comprising a metal substrate having a surface and a hardened and tempered sprayed layer formed on said surface, said sprayed layer consisting essentially of, by weight, 2 to 10% C, 18 to 60% Cr, 0.3 to 20% V, 25% or less Mo, 25% or less W, 10% or less Nb, 10% or less Ti, 10% or less Zr, 10% or less Hf and the balance being Fe in a proportion of 20% or greater, said sprayed layer having a surface hardness of 1000 Hv or greater and having a martensite-phase matrix containing at least carbide particles with a width of 3 μm or less and an areal ratio of 25 to 90% and said sprayed layer further having a surface provided with a carburized layer, a nitrided layer or a carbonitrized layer, and wherein numerous carbide particles are bonded together.

11. A wear-resistant metal member according to claim 10, wherein said martensite-phase matrix contains carbide particles and at least one of nitride particles or carbonitride particles.

12. A wear-resistant metal member according to claim 10, wherein said sprayed layer has a surface hardness of 1200 Hv or greater.

13. A wear-resistant metal member comprising a metal substrate having a surface and a hardened and tempered sprayed layer formed on said surface, said sprayed layer consisting essentially of, by weight, 2.5 to 5% C, 25 to 35% Cr, 3 to 11% V, 25% or less Mo, 25% or less W, 10% or less Nb, 10% or less Ti, 10% or less Zr, 10% or less Hf and the balance being substantially Fe, said sprayed layer having a surface hardness of 1000 Hv or greater and having a martensite-phase matrix containing at least carbide particles with a width of 3 μm or less and an areal having a ratio of 25 to 90% and said sprayed layer further having a surface provided with a carburized layer, a nitrided layer or a carbonitrided layer.

14. A wear-resistant metal member according to claim 13, wherein said martensite-phase matrix contains carbide particles and at least one of nitride particles or carbonitride particles.

15. A wear-resistant metal member according to claim 13, wherein said sprayed layer has a surface hardness of 1200 Hv or greater.

16. A wear-resistant metal member comprising a metal substrate having a surface and a hardened and tempered sprayed layer formed on said surface, said sprayed layer consisting essentially of, by weight, 2.5 to 5% C, 25 to 35% Cr, 3 to 11% V, at least one selected from the group consisting of 2 to 15% Mo, 2 to 10% W, 0.5 to 5% Nb, 0.5 to 5% Ti, 0.5 to 5% Zr and 0.5 to 5% Hf, and the balance being substantially Fe in a proportion of 35% or greater, said sprayed layer having a surface hardness of 1000 Hv or greater and having a martensite-phase matrix containing at least carbide particles with a width of 3 μm or less an a real ratio of 40 to 90% and said sprayed layer further having a surface provided with a carburized layer, a nitrided layer or a carbonitrided layer, and wherein numerous carbide particles are bonded together.

17. A wear-resistant metal member according to claim 16, wherein said martensite-phase matrix contains carbide particles and at least one of nitride particles or carbonitride particles.

18. A wear-resistant metal member according to claim 16, wherein said sprayed layer has a surface hardness of 1200 Hv or greater.

19. A wear-resistant sliding mechanism comprising metal members which are maintained in sliding contact with each other, at least one of said metal members having a sliding surface provided with a hardened and tempered sprayed layer consisting essentially of, by weight, 2 to 10% C, 18 to 60% Cr, 0.3 to 20% V, 25% or less Mo, 25% or less W, 10% or less Nb, 10% or less Ti, 10% or less Zr, 10% or less Hf and the balance being Fe in a proportion of 20% or greater, said sprayed layer having a surface hardness of 1000 Hv or greater and having a martensite-phase matrix containing at least carbide particles with a width of 3 μm or less and an areal ratio of 25 to 90%.

20. A wear-resistant sliding member according to claim 14, wherein said martensite-phase contains carbide particles and at least one of nitride particles or carbonitride particles.

21. A wear-resistant sliding member according to claim 19, wherein said sprayed layer has a surface hardness of 1200 Hv or greater.

22. A wear-resistant sliding mechanism comprising metal members which are maintained in sliding contact with each other, at least one of said metal members having a sliding surface provided with a hardened and tempered sprayed layer consisting essentially of, by weight, 2 to 10% C, 18 to 60% Cr, 0.3 to 20% V, 25% or less Mo, 25% or less W, 10% or less Nb, 10% or less Ti, 10% or less Zr, 10% or less Hf and the balance being Fe in a proportion of 20% or greater, said sprayed layer having a surface hardness of 1000 Hv or greater and having a martensite-phase matrix containing at least carbide particles with a width of 3 μm or less and an areal ratio of 25 to 90% and said sprayed layer further having a surface provided with a carburized layer, a nitrided layer or a carbonitrided layer.

23. A wear-resistant sliding member according to claim 22, wherein said martensite-phase matrix contains carbide particles and at least one of nitride particles or carbonitride particles.

24. A wear-resistant sliding member according to claim 22, wherein said sprayed layer has a surface hardness of 1200 Hv or greater.

25. A valve gear for use in an internal combustion engine which is adapted to employ a thrust generated by the rotation of a cam wheel to cause a valve stem to reciprocally move, said valve gear comprising metal members which are maintained in sliding contact with each other, at least one of said metal members having a sliding surface provided with a hardened and tempered sprayed layer consisting essentially of, by weight, 2 to 10% C, 18 to 60% Cr, 0.3 to 20% V, 25% or less Mo, 25% or less W, 10% or less Nb, 10% or less Ti, 10% or less Zr, 10% or less Hf and the balance being Fe in a proportion of 20% or greater, said sprayed layer having a surface hardness of 1000 Hv or greater and having a martensite-phase matrix containing at least carbide particles with a width of 3 μm or less and an areal ratio of 25 to 90%.

26. A valve gear according to claim 25, wherein said martensite-phase matrix contains carbide particles and at least one of nitride particles or carbonitride particles.

27. A valve gear according to claim 25, wherein said sprayed layer has a surface hardness of 1200 Hv or greater.

28. The valve gear according to claim 25, wherein said sprayed layer is a hard coating having a thickness of 0.1 to 0.75 mm.

29. The valve gear according to claim 25, wherein an oxygen content in said sprayed layer is 1500 ppm or less.

30. The valve gear according to claim 25, including a valve lifter, wherein a carbon content in said valve lifter body is 0.1 to 0.4%.

31. The valve gear according to claim 25, wherein a carbon concentration in the surface of said sprayed layer which comes into sliding contact with the cam wheel is higher than that in the portion of said sprayed layer adjacent to a base material.

32. A valve gear for use in an internal combustion engine which is adapted to employ a thrust generated by the rotation of a cam to cause a valve stem to reciprocally move, said valve stem having a sliding surface which comes into sliding contact with said cam and provided with a hardened and tempered coating consisting having a surface hardness of 1000 or greater, said by weight, 2 to 20% C, 18 to 60% Cr, 0.3 to 20% V, 25% or less Mo, 25% or less W, 10% or less Nb, 10% or less Ti, 10% or less Zr, 10% or less Hf and the balance being Fe in a proportion of 20% or greater, 80% or greater of the carbon content forming a carbide, and said hard coating and the body of a valve lifter being bonded together by a diffused layer.

33. A valve gear according to claim 32, wherein said coating further includes at least one of a nitride and a carbonitride.

34. A valve gear according to claim 32, wherein said coating has a surface hardness of 1200 Hv or greater.

35. A valve gear for use in an internal combustion engine which is adapted to employ a thrust generated by the rotation of a cam to cause a valve stem to reciprocally move, said valve gear comprising metal members which are maintained in sliding contact with each other, at least one of said metal members having a sliding surface provided with a hardened and tempered sprayed layer consisting essentially of, by weight, 2 to 10% C, 18 to 60% Cr, 0.3 to 20% V, 25% or less Mo, 25% or less W, 10% or less Nb, 10% or less Ti, 10% or less Zr, 10% or less Hf and the balance being Fe in a proportion of 20% or greater, said sprayed layer having a surface hardness of 1000 Hv or greater and having a martensite-phase matrix containing at least carbide particles with a width of 3 μm or less and an areal ratio of 25 to 90% and said sprayed layer further having a surface provided with a carburized layer, a nitrided layer or a carbonitrided layer.

36. A valve gear according to claim 35, wherein said martensite-phase matrix contains carbide particles and at least one of nitride particles or carbonitride particles.

37. A valve gear according to claim 35, wherein said sprayed layer has a surface hardness of 1200 Hv or greater.

* * * * *